US008995898B2

(12) United States Patent
Umetsu

(10) Patent No.: US 8,995,898 B2
(45) Date of Patent: Mar. 31, 2015

(54) IMAGE FORMING APPARATUS AND IMAGE ERASING APPARATUS

(71) Applicants: Kabushiki Kaisha Toshiba, Tokyo (JP); Toshiba Tec Kabushiki Kaisha, Tokyo (JP)

(72) Inventor: Toshiyuki Umetsu, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 5 days.

(21) Appl. No.: 13/953,646

(22) Filed: Jul. 29, 2013

(65) Prior Publication Data

US 2014/0212192 A1 Jul. 31, 2014

(30) Foreign Application Priority Data

Jan. 30, 2013 (JP) ..... 2013-15601

(51) Int. Cl.
*G03G 15/20* (2006.01)
*G03G 15/00* (2006.01)
*G03G 15/01* (2006.01)

(52) U.S. Cl.
CPC ..... *G03G 15/01* (2013.01); *G03G 15/6585* (2013.01)
USPC ..... 399/341; 399/411

(58) Field of Classification Search
USPC ..... 399/341, 411
See application file for complete search history.

(56) References Cited

U.S. PATENT DOCUMENTS

| | | | | |
|---|---|---|---|---|
| 4,413,899 | A * | 11/1983 | Karasawa et al. | 399/184 |
| 8,478,151 | B2 * | 7/2013 | Iguchi et al. | 399/63 |
| 2006/0088350 | A1 * | 4/2006 | Imamiya | 399/333 |
| 2009/0154970 | A1 * | 6/2009 | Yoshida et al. | 399/341 |
| 2010/0196063 | A1 * | 8/2010 | Iguchi et al. | 399/322 |
| 2010/0290812 | A1 * | 11/2010 | Taguchi et al. | 399/223 |
| 2011/0262197 | A1 * | 10/2011 | Imamiya et al. | 399/341 |
| 2011/0274445 | A1 | 11/2011 | Kabai | |
| 2012/0082484 | A1 * | 4/2012 | Shimmura et al. | 399/223 |
| 2012/0282545 | A1 * | 11/2012 | Kabai et al. | 430/137.14 |

* cited by examiner

*Primary Examiner* — G. M. Hyder
(74) *Attorney, Agent, or Firm* — Patterson & Sheridan LLP

(57) ABSTRACT

According to embodiments, an image forming apparatus and an image erasing apparatus are disclosed. The image forming apparatus receives a degree of freedom regarding whether to erase an image and forms the image using an erasable color material corresponding to the degree of freedom. The image erasing apparatus receives a degree of freedom regarding whether to erase an image and erases the image under the erasing process condition corresponding to the degree of freedom.

10 Claims, 6 Drawing Sheets

IMAGE FORMING APPARATUS AND IMAGE ERASING APPARATUS

CROSS-REFERENCE TO RELATED APPLICATION

This application is based upon and claims the benefit of priority from Japanese Patent Application No. 2013-15601, filed on Jan. 30, 2013, the entire contents of which are incorporated herein by reference.

FIELD

Embodiments described herein relate generally to an image forming apparatus which forms an erasable image, and to an image erasing apparatus which erases an image.

BACKGROUND

An image erasing apparatus for erasing an image printed on a sheet is known. The image erasing apparatus includes an erasing unit that performs an erasing process, for example, heat process on a sheet on which an image is printed with an erasable color material to erase a color of an image on the sheet or to make a color of the color material forming the image transparent.

A user visually determines a level regarding whether to erase the image printed on the sheet before erasing the image using the erasing unit. The level regarding whether to erase the image refers to a level regarding whether erase of the image may be erased without restrictions.

The image erasing apparatus includes an image reading unit which reads the image of the sheet before erasing the image using the erasing unit, and a monitor which displays the read image before erasing the image using the erasing unit. The user views the image displayed on the monitor to determine the level regarding whether to erase the image.

If the user determines that a image to be erased is highly confidential in its contents and requires permission from a person who has predetermined authority in order to erase the image, the user may judge that the image to be erased is an image having a high level regarding whether to erase the image. If the user determines that an image to be erased is a brief note and is not required to check the contents of the image in order to erase the image, the user may judge that the image to be erased is an image at a low level regarding whether to erase the image. The user judges such a level regarding whether to erase an image for every sheet.

However, the level regarding whether to erase the image is visually judged by the user so that an erroneous judgment may be made. Since the user judges the level regarding whether to erase an image for every sheet, it is difficult to continuously erase images printed on a plurality of sheets so that it takes a long time to erase the images. Further, as the image reading unit is also required, the cost is increased for the image reading unit. It is burdensome to visually judge even an image of a low level regarding whether to erase an image.

DETAILED DESCRIPTION

According to an embodiment, an image forming apparatus which forms an erasable image on a recording medium is provided. The image forming apparatus includes an image forming unit, an operation unit, and a control unit. The image forming unit accommodates a plurality of color materials which is erasable and has different erasing properties and forms an erasable image on a recording medium using at least one of the color materials. The operation unit receives selection of degrees of freedom regarding whether to erase the image formed by the image forming unit. The control unit allows the image forming unit to form the image using the at least one of color materials corresponding to the at least one of the degrees of freedom received by the operation unit.

According to another embodiment, an image erasing apparatus which erases an image formed on the recording medium is provided. The image erasing apparatus includes an erasing unit, an operation unit, and a control unit. The erasing unit erases the image on the recording medium using at least one of a plurality of erasing process conditions. The operation unit receives selection of at least one of degrees of freedom regarding whether to erase the image which is formed on the recording medium. The control unit allows the erasing unit to erase the image using the at least one of the erasing process conditions corresponding to the at least one of the degrees of freedom received by the operation unit.

Figure 1:
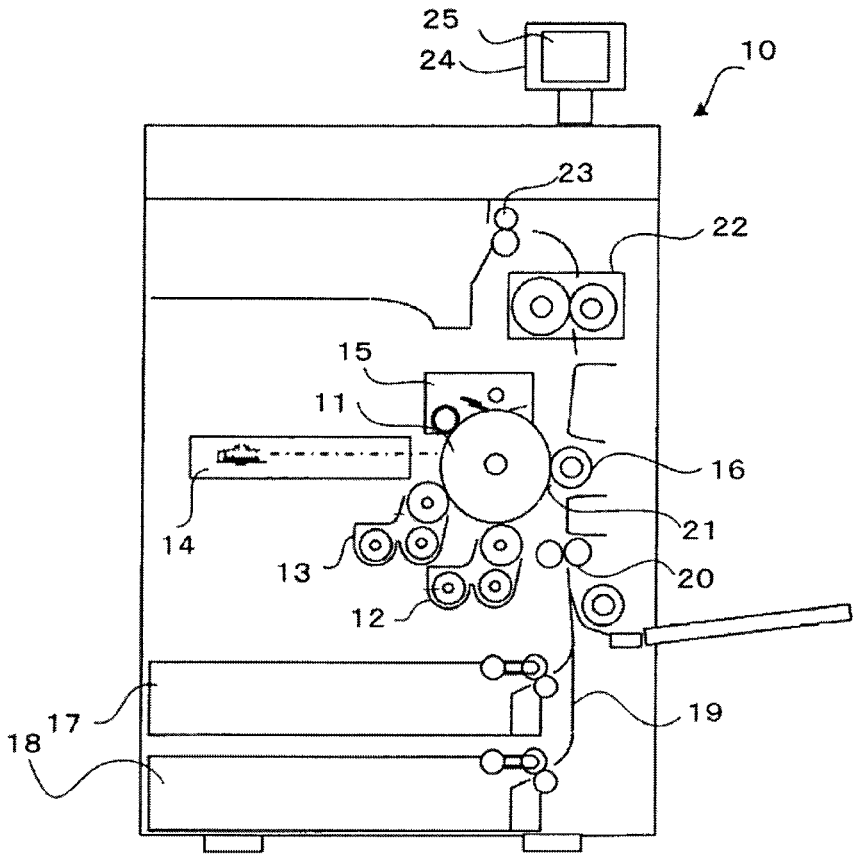
FIG. 1 is a cross-sectional view illustrating an image forming apparatus according to a first embodiment.

Hereinafter, further embodiments will be described further with reference to the drawings. In the drawings, the same reference numeral denotes the same or similar part. FIG. 1 is a cross-sectional view illustrating an image forming apparatus according to a first embodiment. As illustrated in FIG. 1, an image forming apparatus 10 prints an erasable image on a recording medium, for example, a sheet using, for example, a well-known electrophotographic method as an image forming method. The image forming apparatus 10 includes an image forming unit. The image forming unit includes a first developing unit 12, a second developing unit 13, a laser exposing unit 14, a cleaning unit 15, and a transfer unit 16 which are disposed around a photosensitive drum 11 which is an image carrier.

The photosensitive drum 11 is rotatably provided in the image forming apparatus 10, and is charged with an electrostatic charge having a predetermined polarity by a charging unit (not illustrated), before being exposed by the laser exposing unit 14. The laser exposing unit 14, for example, has a light source which emits laser light, an exposure control unit which modulates the laser light based on information of an original image from a personal computer or a scanner, and an optical system which guides the laser light to the photosensitive drum 11. The laser exposing unit 14 exposes the photosensitive drum 11 using the laser light to form an electrostatic latent image corresponding to an original image on the photosensitive drum 11.

The first developing unit 12 includes an accommodating unit which accommodates a first toner which is a color material and a development roller which supplies a first toner charged with a predetermined polarity to the photosensitive drum 11. The second developing unit 13 includes an accommodating unit which accommodates a second toner which is a color material and a development roller which supplies a second toner charged with a predetermined polarity to the photosensitive drum 11. The first or second developing unit 12 or 13 supplies the first or second toner to the photosensitive drum 11 to develop the electrostatic latent image. After development, the first or second toner is electrostatically adhered to the electrostatic latent image to form a toner image on the photosensitive drum 11. One of the first developing unit 12 and the second developing unit 13 which is selected to operate by the user using an operation unit 24, which will be described below operates.

The first toner and the second toner according to the first embodiment are erasable color materials. The first toner and the second toner are color materials which have their own colors and color an image. When the first toner and the second toner are heated at a predetermined temperature or higher, the colors of the toners are erased or the colors of the toners become transparent. The predetermined temperatures (hereinafter, referred to as "erasing temperatures"), which are erasing properties, are different for the first toner and the second toner. The erasing temperature of the first toner (hereinafter, referred to as "a first erasing temperature") is configured to be higher than the erasing temperature of the second toner (hereinafter, referred to as "a second erasing temperature"). The first toner and the second toner are configured such that the first erasing temperature and the second erasing temperature are higher than a fixing temperature for a fixing process which will be described below. Hereinafter, examples of the first toner and the second toner will be described.

Each of the first toner and the second toner includes a resin and a coloring agent. The coloring agent includes a coloration compound, a color developer, and a discoloration temperature regulator. The coloration compound is a color forming agent, and may use, for example, a leuco dye. The color developer may use, for example, phenols. If the discoloration temperature regulator is heated, the discoloration temperature regulator is compatible with the coloration compound and may use a material which does not have affinity for the color developer. The toner appears as a color when an interaction occurs between the coloration compound and the color developer and if the toner is heated at the erasing temperature or higher, the interaction between the coloration compound and the color developer is cut off so that the color of the toner disappears (a color of the toner becomes transparent). Further, the first toner and the second toner are appropriately combined with the discoloration temperature regulator so that the first erasing temperature becomes higher than the second erasing temperature.

The transfer unit 16 has, for example, a transfer roller which charges a sheet S so as to have a reverse polarity to that of the toner. The transfer unit 16 charges the sheet S which is conveyed to a transfer position 21 which is opposite to the photosensitive drum 11 to have a reverse polarity to that of the toner. The toner image of the photosensitive drum 11 is electrostatically adhered onto the sheet S to be transferred onto the sheet S.

The cleaning unit 15, for example, includes a cleaning blade which is in contact with the photosensitive drum 11 to collect the toner from the photosensitive drum 11. The cleaning unit 15 collects the toner which remains on the photosensitive drum 11 after being transferred from the photosensitive drum 11 to clean the photosensitive drum 11. The photosensitive drum 11 is in a state where residual charges after cleaning are neutralized by a neutralizing unit, which is not illustrated, so as to form the toner image again.

The image forming unit of the image forming apparatus further includes sheet feeding units 17 and 18, a conveying unit 19, a fixing unit 22, and a sheet discharging unit 23. The sheet feeding units 17 and 18 include a plurality of sheet feeding cassettes which accommodates the sheet S onto which the toner image will be transferred and a sheet feeding roller which ejects the sheet S from the sheet feeding cassettes. The sheet feeding cassette may accommodate sheets S each having different sizes, for example.

The conveying unit 19 has a conveying mechanism, which conveys a sheet S, such as a registration roller 20 which is controlled to be rotated at a predetermined amount or stopped. The conveying unit 19 temporally abuts the sheet S ejected by the sheet feeding units 17 and 18 against the registration roller 20, which is stopped, to adjust a gradient of the sheet S. Thereafter, the conveying unit 19 rotates the registration roller 20 to convey the sheet S to the transfer position 21 at a rotating timing of the photosensitive drum 11 on which the toner image is formed.

The fixing unit 22 includes a heating roller having a heat source and a pressure roller which is pressure-contacted with the heating roller and the heat source is controlled by the control unit which will be described below so that a surface of the heating roller is maintained at the fixing temperature. The fixing unit 22 applies a pressure to the toner image onto the sheet S while heating the toner image at the fixing temperature by conveying the transferred sheet S so as to be interposed between the heating roller and the pressure roller. As a result, the fixing unit 22 fixes the toner image onto the sheet S.

The sheet discharging unit 23 includes a rotating sheet discharging roller. The sheet discharging unit 23 discharges the fixed sheet S to a sheet discharging tray which is provided outside the image forming apparatus 10 using the sheet discharging roller. The image which is formed on the sheet S is formed by the first toner or the second toner. Accordingly, for example, in the image erasing apparatus, which will be described below, the image is heated at the erasing temperature or higher to erase the color of the toner and erase the image which is formed on the sheet S.

The image forming apparatus 10 further includes the operation unit 24 which is provided above a main body of the apparatus 10. The operation unit 24 has a plurality of keys such as an image formation starting key and a touch panel type monitor 25 in order to receive the operation by the user. The operation unit 24 receives the operation by the user and outputs an operation signal in response to the operation of the user. The monitor 25 displays an erasing mode selection screen 30 for selecting a condition to form an image on the sheet S. The erasing mode selection screen has a mode display portion and a degree of freedom selecting portion.

In the first embodiment, it is possible to receive the selection of a degree of freedom regarding whether to erase the printed image which erases the printed image, as a condition to form an image. Specifically, the monitor 25 displays the erasing mode selection screen 30 in order to allow the user to select the degree of freedom regarding whether to erase the image. The monitor 25 receives the operation to select the degree of freedom by the user by using the mode display portion and the degree of freedom selecting portion of the erasing mode selection screen 30.

A degree of freedom regarding whether to erase the image is varied in accordance with modes for determining whether to erase the image by the user. In the first embodiment, the monitor 25 displays a plurality of modes including such as an erasing level mode, an erasing temperature mode, a confidentiality mode, an erasing attention mode on the mode display portions in order to determine whether to erase the image.

The erasing level mode refers to a mode for determining whether to erase the image without restrictions. As the degree of freedom corresponding to the erasing level mode, the monitor 25 displays characters of "low erasing level" and "high erasing level" on the degree of freedom selection portion. The low erasing level means that the printed image may be erased without restrictions and the degree of freedom is high. The high erasing level means that it is hardly permitted to erase the printed image without restrictions and the degree of freedom is low.

The erasing temperature mode refers to a mode for determining whether to erase the image at a low erasing temperature. As the degree of freedom corresponding to the erasing temperature mode, the monitor 25 displays characters of "low temperature" and "high temperature" on the degree of freedom selection portions. The low temperature means that the image may be erased at a low temperature and the degree of freedom is high. The high temperature means that the image may be erased at a high temperature and the degree of freedom is low.

The confidentiality mode refers to a mode for determining whether to erase the image based on contents of characters contained in the image. As the degree of freedom corresponding to the confidentiality mode, the monitor 25 displays characters of "low confidential" and "high confidential" on the degree of freedom selection portion. The low confidential means that the contents of the characters contained in the image have low confidentiality and the degree of freedom is high. The high confidential means that the contents of the characters contained in the image have high confidentiality and the degree of freedom is low.

The erasing attention mode refers to a mode for determining whether to erase the image without attention for erasing the image. As the degree of freedom corresponding to the erasing attention mode, the monitor 25 displays characters of "attention required" and "no attention required" on the degree of freedom selection portion. The "no attention required" means that an attention to erase the image is not required and the degree of freedom is high. The "attention required" means that an attention to erase the image is required and the degree of freedom is low.

FIGS. 2A to 2D illustrate examples of the erasing mode selection screen 30 according to the first embodiment. As illustrated in FIGS. 2A to 2D, the erasing mode selection screen 30 includes an erasing level mode display portion 31, an erasing temperature mode display portion 32, a confidentiality mode display portion 33, and an erasing attention mode display portion 34, as mode display portions. The monitor 25 displays the mode display portions 31 to 34 on the erasing mode selection screen 30, as a menu for allowing the user to select a mode for determining whether to erase the image.

The erasing level mode display portion 31 corresponds to the erasing level mode which is one of the modes for determining whether to erase the image. The erasing temperature mode display portion 32 corresponds to the erasing temperature mode which is one of the modes for determining whether to erase the image. The confidentiality mode display portion 33 corresponds to the confidentiality mode which is one of the modes for determining whether to erase the image. The erasing attention mode display portion 34 corresponds to the erasing attention mode which is one of the modes for determining whether to erase the image. In the mode display portions 31 to 34, display colors which are displayed on the erasing mode selection screen 30 may be changed.

The erasing mode selection screen 30 further includes a first degree of freedom selecting portion 41 and a second degree of freedom selecting portion 42 as degree of freedom selecting portions. The monitor 25 displays the first degree of freedom selecting portion 41 and the second degree of freedom selecting portion 42 on the erasing mode selection screen 30 as a menu for allowing the user to select a level of a degree of freedom regarding whether to erase the image. The first degree of freedom selecting portion 41 has a degree of freedom display portion which displays characters indicating that the degree of freedom is low. The second degree of freedom selecting portion 42 has a degree of freedom display portion which displays characters indicating that the degree of freedom is high.

The monitor 25 changes display colors of the mode display portions 31 to 34 in response to receiving the operation (touch) of the user with respect to the mode display portions 31 to 34. The monitor 25 changes the displayed characters (characters indicating that the degree of freedom is low) of the first degree of freedom selecting portion 41 and the displayed characters (characters indicating that the degree of freedom is high) of the second degree of freedom selecting portion 42 in response to receiving the operation of the user with respect to the mode display portions 31 to 34. Specifically, the monitor 25 displays the characters indicating that the degree of freedom is low on the first degree of freedom selecting portion 41 in response to the mode for determining whether to erase the image. Further, the monitor 25 displays the characters indicating that the degree of freedom is high on the second degree of freedom selecting portion 42 in response to the mode for determining whether to erase the image. The character display indicating the mode in the mode display portions 31 to 34 or the character display indicating the degree of freedom in the degree of freedom selecting portions 41 and 42 are not limited to the above description but if the user may intuitively determine whether to erase the image, any display type is allowed. Further, not only the character display, but also a Figure or a symbol may be used.

Figure 2A:
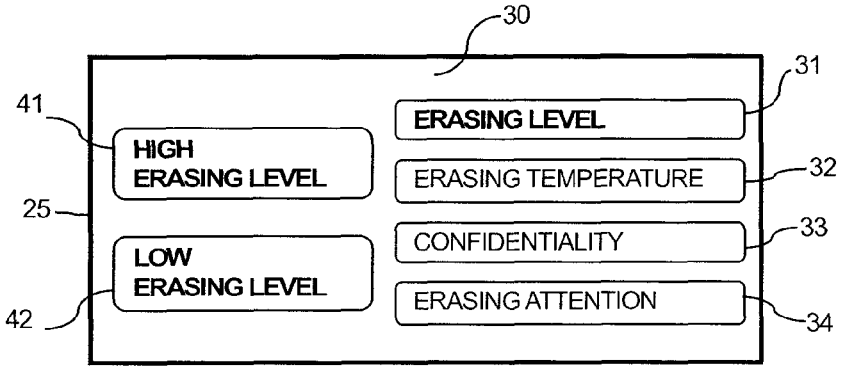
FIGS. 2A to 2D are views illustrating an erasing mode selection screen of a monitor which is used in the first embodiment.

FIG. 2A illustrates the erasing mode selection screen 30 in a state where the erasing level mode display portion 31 receives the operation of the user (erasing level mode). As illustrated in FIG. 2A, the monitor 25 changes the display color of the erasing level mode display portion 31 from gray to black in response that the erasing level mode display portion 31 receives the operation of the user. Further, in response that the erasing level mode display portion 31 receives the operation of the user, the monitor changes displayed contents of the first degree of freedom selecting portion 41 into characters of "high erasing level" indicating that the degree of freedom is low and displayed contents of the second degree of freedom selecting portion 42 into characters of "low erasing level" indicating that the degree of freedom is high. Therefore, in the erasing mode selection screen 30 illustrated in FIG. 2A, the user determines the degree of freedom regarding whether to erase the image from the erasing level mode to select the "high erasing level" or the "low erasing level". The monitor 25 displays a state where the erasing level mode display portion 31 is selected, as illustrated in FIG. 2A, as an initial screen of the erasing mode selection screen 30.

Figure 2B:
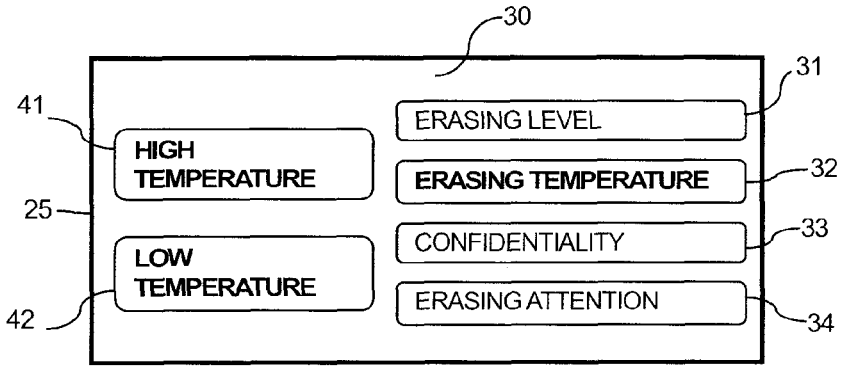

FIG. 2B illustrates the erasing mode selection screen 30 in a state where the erasing temperature mode display portion 32 receives the operation of the user (erasing temperature mode). As illustrated in FIG. 2B, in response that the erasing temperature mode display portion 32 receives the operation of the user, the monitor 25 changes the display color of the erasing temperature mode display portion 32 from gray to black. Further, in response that the erasing temperature mode display portion 32 receives the operation of the user, the monitor 25 changes displayed contents of the first degree of freedom selecting portion 41 into characters of "high temperature" indicating that the degree of freedom is low and displayed contents of the second degree of freedom selecting portion 42 into characters of "low temperature" indicating that the degree of freedom is high. Therefore, in the erasing mode selection screen 30 illustrated in FIG. 2B, the user determines the degree of freedom regarding whether to erase the image from the erasing temperature mode to select the "high temperature" or the "low temperature".

Figure 2C:
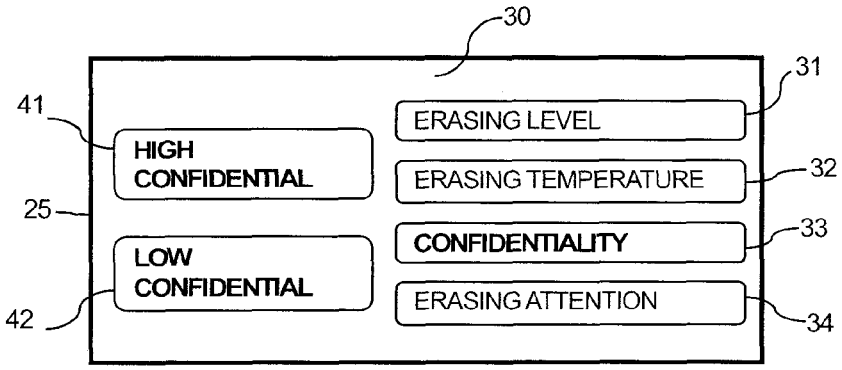

FIG. 2C illustrates the erasing mode selection screen in a state where the confidentiality mode display portion 33 receives the operation of the user (confidentiality mode). As illustrated in FIG. 2C, in response that the confidentiality mode display portion 33 receives the operation of the user, the monitor 25 changes the display color of the confidentiality mode display portion 33 from gray to black. Further, in response that the confidentiality mode display portion 33 receives the operation of the user, the monitor 25 changes displayed contents of the first degree of freedom selecting portion 41 into characters of "high confidential" indicating that the degree of freedom is low and displayed contents of the second degree of freedom selecting portion 42 into characters of "low confidential" indicating that the degree of freedom is high. Therefore, in the erasing mode selection screen 30 illustrated in FIG. 2C, the user determines the degree of freedom regarding whether to erase the image from the confidentiality mode to select the "high confidential" or the "low confidential".

Figure 2D:
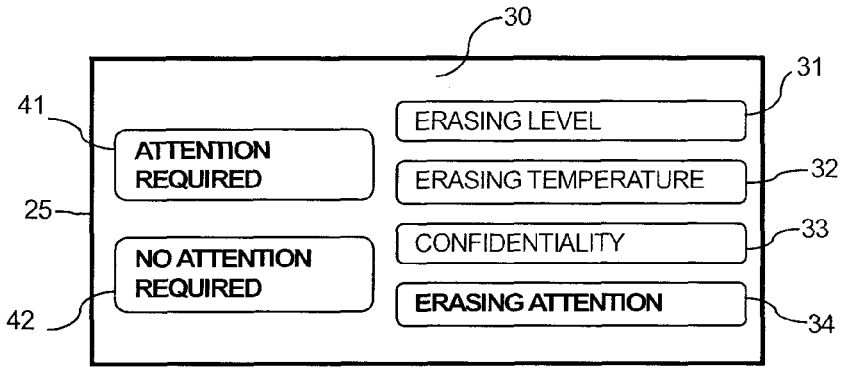

FIG. 2D illustrates the erasing mode selection screen in a state where the erasing attention mode display portion 34 receives the operation of the user (erasing attention mode). As illustrated in FIG. 2D, in response that the erasing attention mode display portion 34 receives the operation of the user, the monitor 25 changes the display color of the erasing attention mode display portion from gray to black. Further, in response that the erasing attention mode display portion 34 receives the operation of the user, the monitor 25 changes displayed contents of the first degree of freedom selecting portion 41 into characters of "attention required" indicating that the degree of freedom is low and displayed contents of the second degree of freedom selecting portion 42 into characters of "no attention required" indicating that the degree of freedom is high. Therefore, in the erasing mode selection screen 30 illustrated in FIG. 2D, the user determines the degree of freedom regarding whether to erase the image from the erasing attention mode to select the "attention required" or the "no attention required".

When a degree of freedom of an image to be printed is low, it is desirable that the printed image is hardly erased. When a degree of freedom of an image to be printed is high, it is desirable that the printed image is easily erased. In the meantime, the printed image is formed by a toner which will be erased (the color of the toner becomes transparent) when being heated at a predetermined erasing temperature or higher. Therefore, when the erasing temperature is high, the printed image is hardly erased but when the erasing temperature is low, the printed image is easily erased. With that, in the first embodiment, the degree of freedom regarding whether to erase the image corresponds to the erasing temperature of the toner. The degree of freedom regarding whether to erase the image corresponds to the first toner and the second toner and also corresponds to the first developing unit 12 and the second developing unit 13 which accommodate the toner. Accordingly, if the monitor 25 receives the operation of selecting the degree of freedom by the user, the image forming apparatus 10 selects the first developing unit 12 or the second developing unit 13 corresponding to the operation of selecting the degree of freedom by the user to form an image. Specifically, the first degree of freedom selecting portion 41 (the degree of freedom is low) corresponds to the first developing unit 12 (the first toner which is hardly erased) and the second degree of freedom selecting portion 42 (the degree of freedom is high) corresponds to the second developing unit 13 (the second toner which is easily erased).

Figure 3:
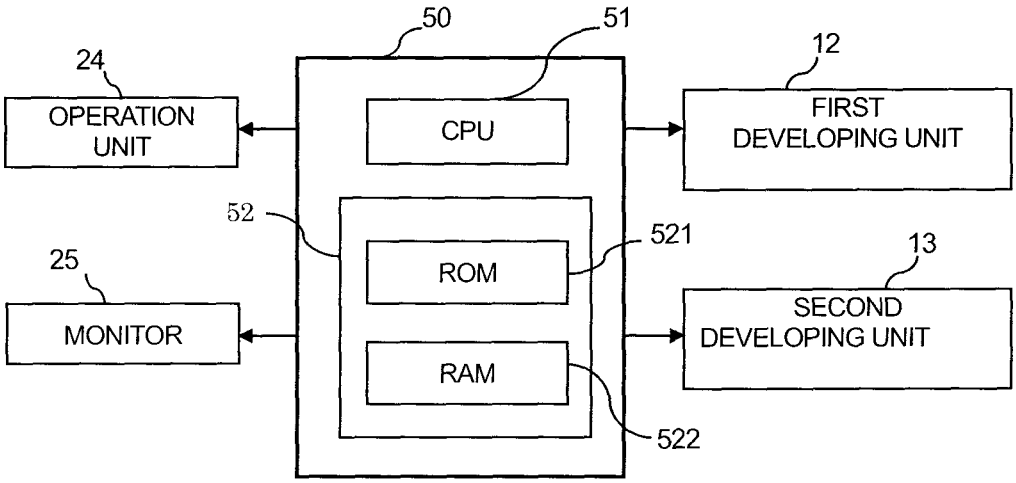
FIG. 3 is a block diagram illustrating a control unit which controls the image forming apparatus according to the first embodiment.

The image forming apparatus 10 further includes a control unit which controls each part. FIG. 3 is a control block diagram illustrating a control unit which controls the image forming apparatus 10 according to the first embodiment. As illustrated in FIG. 3, a control unit 50 includes a processor 51, for example, configured by a CPU (central processing unit) and a memory 52.

The processor 51 acquires an operation signal from the operation unit 24 to read out display data of the erasing mode selection screen 30 (the erasing mode selection screen 30 illustrated in FIGS. 2A to 2D) corresponding to the mode display portions 31 to 34 which receive the operation of the user, from the memory 52 and allows the erasing mode selection screen 30 illustrated in FIGS. 2A to 2D to be displayed on the monitor 25. The processor 51 further acquires the operation signal of the operation unit 24 to select the first developing unit 12 or the second developing unit 13 corresponding to the degree of freedom selecting portions 41 and 42 which receive the operation of the user. The processor 51 acquires the operation signal from the operation unit 24 to control the operation of each part of the image forming apparatus 10 described above.

The memory 52 is, for example, a semiconductor memory and includes a ROM (read only memory) 521 and a RAM (random access memory) 522. The ROM 521 stores various control programs for performing display control of the monitor, selection control of the developing units 12 and 13, and the operation control of each part of the image forming apparatus 10. Further, the ROM 521 stores display data for displaying the erasing mode selection screen 30 illustrated in FIGS. 2A to 2D. In addition, the RAM 522 has a storage area as a working area which is temporally provided to the processor 51 when the processor 51 performs the above-mentioned control operation.

Hereinafter, an operation of the image forming apparatus 10, which selects the first developing unit 12 or the second developing unit 13 based on the control of the processor 51 to form an image on the sheet S, will be described. The operation unit 24 receives the operation by the user to output the operation signal to the processor 51. The processor 51 reads out the display data of the erasing mode selection screen 30 illustrated in FIG. 2A from the ROM 521. The monitor 25 displays the erasing mode selection screen 30 illustrated in FIG. 2A (the erasing mode selection screen 30 in the erasing level mode) based on the read out display data, as an initial screen.

In the initial screen, the erasing level mode display portion 31 is displayed in black and the erasing temperature mode display portion 32, the confidentiality mode display portion 33, and the erasing attention mode display portion 34 are displayed in gray. By the difference in the display colors of the mode display portions 31 to 34, the user may visually recognize that the erasing mode selection screen 30 is in the erasing level mode. In the initial screen, characters of the high erasing level are displayed on the first degree of freedom selecting portion 41 and characters of the low erasing level are displayed on the second degree of freedom selecting portion 42. The user may determine the degree of freedom regarding whether to erase the image from the erasing level mode to select the "high erasing level" or the "low erasing level".

For example, when the image which may be erased without restrictions, by the image erasing apparatus which will be described below, is formed on the sheet S (in case that the degree of freedom of erasing the image is high), in the erasing mode selection screen 30 in the erasing level mode, the user touches the second degree of freedom selecting portion 42 to select the "low erasing level" and operates an image formation starting key of the operation unit 24. The operation unit 24 receives the operation by the user to output the operation signal to the processor 51. The processor 51 selects the second developing unit 13 corresponding to the second degree of freedom selecting portion 42 as a developing unit which forms a toner image and starts the operation of each part of the image forming apparatus 10. The photosensitive drum 11 rotates, the laser exposing unit 14 forms an electrostatic latent image on the photosensitive drum 11, and the second developing unit 13 develops the electrostatic latent image. By the development, the toner image by the second toner is formed on the photosensitive drum 11. Further, the transfer unit 16 transfers the toner image from the photosensitive drum 11 to the sheet S and the fixing unit 22 fixes the toner image onto the sheet S. By doing this, the image forming apparatus 10 uses the second developing unit 13 (second toner) to print the image on the sheet S.

For example, when the image which is hardly permitted to be erased without restrictions, by the image erasing apparatus which will be described below, is formed on the sheet S (in case that the degree of freedom of erasing the image is low), in the erasing mode selection screen 30 in the erasing level mode, the user touches the first degree of freedom selecting portion 41 to select the "high erasing level" and operates an image formation starting key of the operation unit 24. The operation unit 24 receives the operation by the user to output the operation signal to the processor 51. The processor 51 selects the first developing unit 12 corresponding to the first degree of freedom selecting portion 41 as a developing unit which forms a toner image and starts the operation of each part of the image forming apparatus 10. The photosensitive drum rotates, the laser exposing unit 14 forms an electrostatic latent image on the photosensitive drum 11, and the first developing unit 12 develops the electrostatic latent image. By the development, the toner image by the first toner is formed on the photosensitive drum 11. Further, the transfer unit 16 transfers the toner image from the photosensitive drum 11 to the sheet S and the fixing unit 22 fixes the toner image onto the sheet S. By doing this, the image forming apparatus 10 uses the first developing unit 12 (first toner) to print the image on the sheet S.

In the initial screen of the erasing mode selection screen 30 illustrated in FIG. 2A, the user selects the erasing temperature mode display portion 32. As a result, the operation unit 24 receives the operation by the user to output the operation signal to the processor 51. The processor 51 reads out the display data of the erasing mode selection screen 30 illustrated in FIG. 2B from the ROM 521. The monitor 25 displays the erasing mode selection screen illustrated in FIG. 2B (the erasing mode selection screen 30 in the erasing temperature mode) based on the read out display data. In the erasing mode selection screen 30 illustrated in FIG. 2B, the display color of the erasing temperature mode display portion 32 is changed from gray to black and the display color of the erasing level mode display portion 31 is changed from black to gray. By the difference in the display colors of the mode display portions 31 to 34, the user may visually recognize that the erasing mode selection screen 30 is in the erasing temperature mode. The displayed characters of the first degree of freedom selecting portion 41 is changed to the "high temperature" and the displayed characters of the second degree of freedom selecting portion 42 is changed to the "low temperature". Therefore, the user may determine the degree of freedom regarding whether to erase the image from the erasing temperature mode to select the "high temperature" or the "low temperature".

For example, when the image which may be erased without restrictions, by the image erasing apparatus which will be described below, is formed on the sheet S (in case that the degree of freedom of erasing the image is high), in the erasing mode selection screen 30 in the erasing temperature mode, the user touches the second degree of freedom selecting portion 42 to select the "low temperature" and operates an image formation starting key of the operation unit 24. The operation unit 24 receives the operation by the user to output the operation signal to the processor 51. The processor 51 selects the second developing unit 13 corresponding to the second degree of freedom selecting portion 42 as a developing unit which forms a toner image and starts the operation of each part of the image forming apparatus 10. By starting the operation, the image forming apparatus 10 uses the second developing unit 13 (second toner) to print the image on the sheet S.

For example, when the image which is hardly permitted to be erased without restrictions, by the image erasing apparatus which will be described below, is formed on the sheet S (in case that the degree of freedom of erasing the image is low), in the erasing mode selection screen 30 in the erasing temperature mode, the user touches the first degree of freedom selecting portion 41 to select the "high temperature" and operates an image formation starting key of the operation unit 24. The operation unit 24 receives the operation by the user to output the operation signal to the processor 51. The processor 51 selects the first developing unit 13 corresponding to the first degree of freedom selecting portion 41 as a developing unit which forms a toner image and starts the operation of each part of the image forming apparatus 10. By doing this, the image forming apparatus 10 uses the first developing unit 12 (first toner) to print the image on the sheet S.

In the initial screen of the erasing mode selection screen 30 illustrated in FIG. 2A, if the user selects the confidentiality mode display portion 33, the operation unit receives the operation of the user to output the operation signal to the processor 51. The processor 51 reads out the display data of the erasing mode selection screen 30 illustrated in FIG. 2C from the ROM 521. The monitor 25 displays the erasing mode selection screen 30 illustrated in FIG. 2C (the erasing mode selection screen in the confidentiality mode) based on the read out display data. In the erasing mode selection screen 30 illustrated in FIG. 2C, the display color of the confidentiality mode display portion 33 is changed from gray to black and the display color of the erasing level mode display portion 31 is changed from black to gray. By the difference in the display colors of the mode display portions 31 to 34, the user may visually recognize that the erasing mode selection screen 30 is in the confidentiality mode. The displayed characters of the first degree of freedom selecting portion 41 is changed to "high confidential" and the displayed characters of the second degree of freedom selecting portion 42 is changed to "low confidential". Therefore, the user may determine the degree of freedom regarding whether to erase the image from the confidentiality mode to select "high confidential" or "low confidential".

For example, when the image which may be freely erased without restrictions, by the image erasing apparatus which will be described below, is formed on the sheet S (in case that the degree of freedom of erasing the image is high), in the erasing mode selection screen 30 in the confidentiality mode, the user touches the second degree of freedom selecting portion 42 to select "low confidential" and operates an image formation starting key of the operation unit 24. The operation unit 24 receives the operation by the user to output the operation signal to the processor 51. The processor 51 selects the second developing unit 13 corresponding to the second degree of freedom selecting portion 42 as a developing unit which forms a toner image and starts the operation of each part of the image forming apparatus 10. By starting the operation, the image forming apparatus 10 uses the second developing unit 13 (second toner) to print the image on the sheet S.

For example, when the image which is hardly permitted to be erased without restrictions, by the image erasing apparatus which will be described below, is formed on the sheet S (in case that the degree of freedom of erasing the image is low), in the erasing mode selection screen 30 in the confidentiality mode, the user touches the first degree of freedom selecting portion 41 to select "high confidential" and operates an image formation starting key of the operation unit 24. The operation unit 24 receives the operation by the user to output the operation signal to the processor 51. The processor 51 selects the first developing unit 13 corresponding to the first degree of freedom selecting portion 41 as a developing unit which forms a toner image and starts the operation of each part of the image forming apparatus 10. By starting the operation, the image forming apparatus 10 uses the first developing unit 13 (first toner) to print the image on the sheet S.

In the initial screen of the erasing mode selection screen 30 illustrated in FIG. 2A, the user selects the erasing attention mode display portion 34. As a result, the operation unit 24 receives the operation of the user to output the operation signal to the processor 51. The processor 51 reads out the display data of the erasing mode selection screen 30 illustrated in FIG. 2D from the ROM 521. The monitor 25 displays the erasing mode selection screen illustrated in FIG. 2D (the erasing mode selection screen 30 in the erasing attention mode) based on the read out display data. In the erasing mode selection screen 30 illustrated in FIG. 2D, the display color of the erasing attention mode display portion 34 is changed from gray to black and the display color of the erasing level mode display portion 31 is changed from black to gray. By the difference in the display colors of the mode display portions 31 to 34, the user visually recognize that the erasing mode selection screen 30 is in the erasing attention mode. The displayed characters of the first degree of freedom selecting portion 41 is changed to "attention required" and the displayed characters of the second degree of freedom selecting portion 42 is changed to "no attention required". Therefore, the user may determine the degree of freedom regarding whether to erase the image from the erasing attention mode to select "attention required" or "no attention required".

For example, when the image which may be freely erased without restrictions, by the image erasing apparatus which will be described below, is formed on the sheet S (in case that the degree of freedom of erasing the image is high), in the erasing mode selection screen 30 in the erasing attention mode, the user touches the second degree of freedom selecting portion 42 to select "no attention required" and operates an image formation starting key of the operation unit 24. The operation unit 24 receives the operation by the user to output the operation signal to the processor 51. The processor 51 selects the second developing unit 13 corresponding to the second degree of freedom selecting portion 42 as a developing unit which forms a toner image and starts the operation of each part of the image forming apparatus 10. By starting the operation, the image forming apparatus 10 uses the second developing unit 13 (second toner) to form the image on the sheet S.

For example, when the image which is hardly permitted to be erased without restrictions, by the image erasing apparatus which will be described below, is formed on the sheet S (in case that the degree of freedom of erasing the image is low), in the erasing mode selection screen 30 in the erasing attention mode, the user touches the first degree of freedom selecting portion 41 to select "attention required" and operates an image formation starting key of the operation unit 24. The operation unit 24 receives the operation by the user to output the operation signal to the processor 51. The processor 51 selects the first developing unit 13 corresponding to the first degree of freedom selecting portion 41 as a developing unit which forms a toner image and starts the operation of each part of the image forming apparatus 10. By starting the operation, the image forming apparatus 10 uses the first developing unit 12 (first toner) to print the image on the sheet S.

As described above, according to the first embodiment, as a condition of printing the image, the user may select a degree of freedom regarding whether to erase the printed image. The degree of freedom corresponds to the erasing temperature. Accordingly, when the user selects the degree of freedom, the user may use the first developing unit 12 which uses the first toner having a high erasing temperature or the second developing unit 13 which uses the second toner having a low erasing temperature to print the image.

According to the first embodiment, the degree of freedom regarding whether to erase the printed image may be selected from different determination modes such as "erasing level", "erasing temperature", "confidentiality", and "erasing attention". Therefore, the user may instinctively determine and easily select the degree of freedom regarding whether to erase the printed image. Further, the user may select the first developing unit 12 or the second developing unit 13 in accordance with, for example, a degree of importance such as a security of a print image.

According to the first embodiment, when the image is erased from the sheet S on which the image is printed by the image erasing apparatus which will be described below, only by changing the heating temperature corresponding to the erasing temperature, the user may erase the image in accordance with a level regarding whether to erase the printed image without visually determining a level regarding whether to erase the printed image (a level indicating whether the print image may be erased without restrictions).

In the first embodiment, two types of toners having different erasing temperatures may be selected but three or more types of toners having different erasing temperature may be selected. In this case, the number of degree of freedom selecting portions in the erasing mode selection screen 30 illustrated in FIGS. 2A to 2D may be three or more in accordance with the types of toners. Further, the displayed contents of the degree of freedom selecting portion are not limited to the above description, and for example, in the erasing level mode, the displayed contents of the degree of freedom selecting portion may be a high erasing level, an intermediate erasing level, and a low erasing level.

Figure 4:
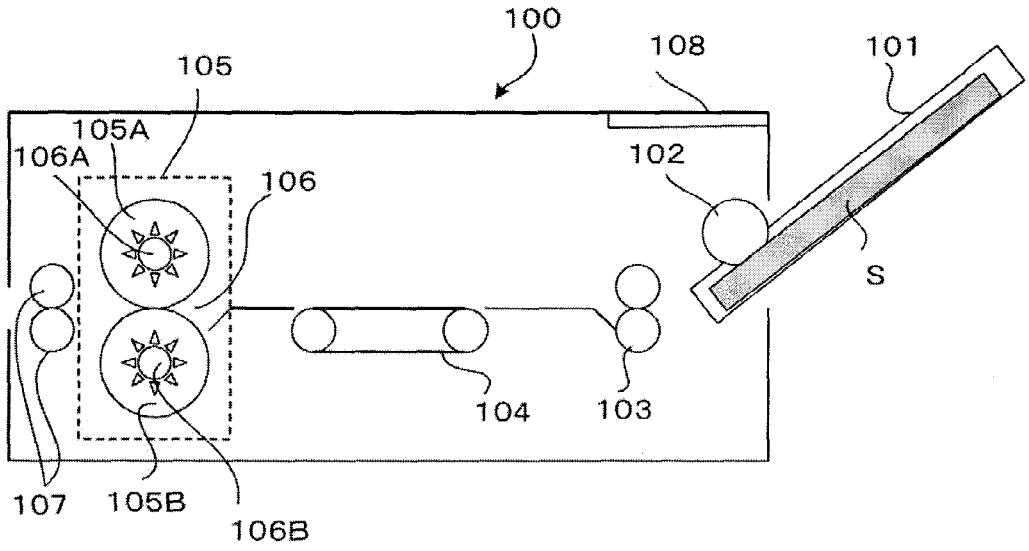
FIG. 4 is a cross-sectional view illustrating an image erasing apparatus according to a second embodiment.

FIG. 4 is a cross-sectional view illustrating an image erasing apparatus according to a second embodiment. An image erasing apparatus 100, for example, erases the image printed on the sheet S by the image forming apparatus 10 according to the first embodiment. The image erasing apparatus 100, as illustrated in FIG. 4, includes a conveyance mechanism which conveys the sheet S, an erasing unit which erases an image which is printed on the sheet S, an operation unit which receives the operation by the user, and a control unit which controls the erasing operation.

The conveyance mechanism includes a sheet feeding unit 101, a sheet feeding roller 102, an aligning roller 103, a conveying unit 104, and a sheet discharging roller 107. The sheet feeding unit 101 includes a sheet feeding cassette which accommodates the sheets S. The sheet feeding roller 102 has one roller which rotates while being in contact with an uppermost sheet S which is accommodated in the sheet feeding unit 101 and ejects the sheet S from the sheet feeding unit 101 one by one. The aligning roller 103 has one pair of rollers which rotates while nipping the sheet S ejected from the sheet feeding unit 101 and conveys the sheet S to the conveying unit 104 at a predetermined timing. The conveying unit 104 has a belt which is bridged over two rollers to endlessly travel. The conveying unit 104 allows the belt to travel in order to convey the sheet S to the erasing unit 105. The sheet discharging roller 107 has one pair of rollers which rotates while nipping the sheet S from which the image is erased and ejects the sheet S to the outside of the apparatus.

The erasing unit 105 includes a heating roller 105*a* and a pressure roller 105*b*. The pressure roller 105*b* is provided so as to be pressure-contacted with the heating roller 105*a* and forms a nip portion 106 between the heating roller 105*a* and the pressure roller 105*b*. The heating roller 105*a* has a first halogen lamp 106*a* therein as a heating source. The pressure roller 105*b* has a second halogen lamp 106*b* therein as a heating source. The first halogen lamp 106*a* and the second halogen lamp 106*b* heat the heating roller 105*a* and the pressure roller 105*b* so that the surface temperatures of the heating roller 105*a* and the pressure roller 105*b* become a predetermined temperature (hereinafter, referred to as a heating temperature) which is the erasing process condition. The heating temperature is controlled by the control unit 120 to be a first heating temperature or a second heating temperature which is lower than the first heating temperature in accordance with the degree of freedom selected by a monitor 109 of an operation unit 108. The first heating temperature is, for example, a heating temperature for erasing the image formed by the first toner of the first embodiment so that if the first heating temperature is equal to or higher than the first erasing temperature, the first heating temperature may be arbitrarily set. The second heating temperature is a heating temperature for erasing the image formed by the second toner of the first embodiment so that if the second heating temperature is equal to or higher than the second erasing temperature, the second heating temperature may be arbitrarily set. The heating roller 105*a* and the pressure roller 105*b* conveys the sheet S while nipping the sheet in the nip portion 106 and pressurize and heat the sheet S at the first heating temperature or the second heating temperature to erase the image which is printed on one side or both sides of the sheet S. In the second embodiment, even though the heating source is provided in both the heating roller 105*a* and the pressure roller 105*b*, the heating source may be provided in one of the heating roller 105*a* and the pressure roller 105*b*, for example, only in the heating roller 105*a*. The heating source is not limited to the lamp.

The operation unit 108 has a plurality of keys such as an image erase starting key and a touch panel type monitor 109 in order to receive operation by the user. The operation unit 108 receives operation by the user and outputs an operation signal to a processor 121 in response to the operation of the user. The monitor 109 displays an erasing mode setting screen 130 for setting the erasing process condition (heating temperature) of the image printed on the sheet S (the image formed by the first toner or the second toner). The erasing mode setting screen 130 includes a mode display portion and a degree of freedom selecting portion which receives the operation (touch) of the user.

In the second embodiment, the user may select a degree of freedom regarding whether to erase the image, in response to the heating temperature which is the erasing process condition of the image. Specifically, the monitor 109 displays the erasing mode setting screen 130 in order to allow the user to select the degree of freedom regarding whether to erase the image. The monitor 109 receives the operation to select the degree of freedom by the user by using the mode display portion and the degree of freedom selecting portion of the erasing mode setting screen 130.

A degree of freedom regarding whether to erase the image varies depending on a mode for determining whether to erase the image by the user. In the second embodiment, similarly to the image forming apparatus 10 of the first embodiment, the monitor 109 displays a plurality of modes including, for example, an erasing level mode, an erasing temperature mode, a confidentiality mode, an erasing attention mode, as the mode for determining whether to erase the image, on the mode display portion.

FIGS. 6A to 6D illustrate examples of the erasing mode setting screen according to the second embodiment. As illustrated in FIGS. 6A to 6D, the erasing mode setting screen 130 includes an erasing level mode display portion 131, an erasing temperature mode display portion 132, a confidentiality mode display portion 133, and an erasing attention mode display portion 134, as mode display portions. The monitor 109 displays the mode display portions 131 to 134 on the erasing mode setting screen 130 as a menu for allowing the user to select a mode for determining whether to erase the image.

The erasing level mode display portion 131 corresponds to the erasing level mode which is one of the modes for determining whether to erase the image. The erasing temperature mode display portion 132 corresponds to the erasing temperature mode which is one of the modes for determining whether to erase the image. The confidentiality mode display portion 133 corresponds to the confidentiality mode which is one of the modes for determining whether to erase the image. The erasing attention mode display portion 134 corresponds to the erasing attention mode which is one of the modes for determining whether to erase the image. Further, in the mode display portions 131 to 134, display colors which are displayed on the erasing mode setting screen 130 may be changed.

The erasing mode setting screen 130 further includes a first degree of freedom selecting portion 141 and a second degree of freedom selecting portion 142, as degree of freedom selecting portions. The monitor 109 displays the first degree of freedom selecting portion 141 and the second degree of freedom selecting portion 142 on the erasing mode setting screen 130, as a menu for allowing the user to select a level of a degree of freedom regarding whether to erase the image. The first degree of freedom selecting portion 141 has a degree of freedom display portion which displays characters indicating that the degree of freedom is low. The second degree of freedom selecting portion 142 has a degree of freedom display portion which displays characters indicating that the degree of freedom is high.

The monitor 109 changes display colors of the mode display portions 131 to 134 in response to receiving the operation (touch) of the user with respect to the mode display portions 131 to 134. The monitor 109 changes displayed contents (characters indicating that the degree of freedom is low) of the first degree of freedom selecting portion 141 and displayed contents (characters indicating that the degree of freedom is high) of the second degree of freedom selecting portion 142, in response to receiving the operation (touch) of the user with respect to the mode display portions 131 to 134. Specifically, the monitor 109 displays characters indicating that the degree of freedom is low on the first degree of freedom selecting portion 141 in accordance with the mode for determining the degree of freedom selected by the user and characters indicating that the degree of freedom is high on the second degree of freedom selecting portion 142 in accordance with the mode for determining the degree of freedom selected by the user. The character display indicating the mode in the mode display portions 131 to 134 or the character display indicating the degree of freedom in the degree of freedom selecting portions 141 and 142 are not limited to the above description, but if the user may intuitively determine whether to erase the image, any display type is allowed. Further, not only the character display, but also a Figure or a symbol may be used.

Figure 6A:
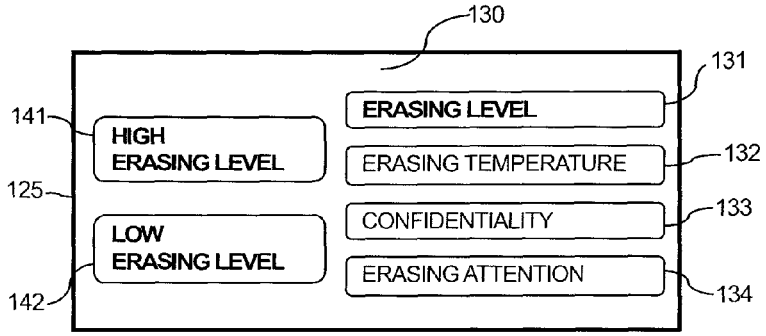
FIGS. 6A to 6D are views illustrating an erasing mode setting screen of a monitor which is used in the second embodiment.

FIG. 6A illustrates the erasing mode setting screen 130 in a state where the erasing level mode display portion 131 receives the operation (touch) of the user (erasing level mode). As illustrated in FIG. 6A, in response that the erasing level mode display portion 131 receives the operation of the user, the monitor 109 changes the display color of the erasing level mode display portion 131 from gray to black. Further, in response that the erasing level mode display portion 131 receives the operation of the user, the monitor 109 changes displayed contents of the first degree of freedom selecting portion 141 into characters of "high erasing level" indicating that the degree of freedom is low and displayed contents of the second degree of freedom selecting portion 142 into characters of "low erasing level" indicating that the degree of freedom is high. Therefore, in the erasing mode setting screen 130 illustrated in FIG. 6A, the user determines the degree of freedom regarding whether to erase the image from the erasing level mode to select "high erasing level" or "low erasing level". The monitor 109 displays a state where the erasing level mode display portion 131 is selected (erasing level mode), as illustrated in FIG. 6A, as an initial screen of the erasing mode setting screen 130.

Figure 6B:
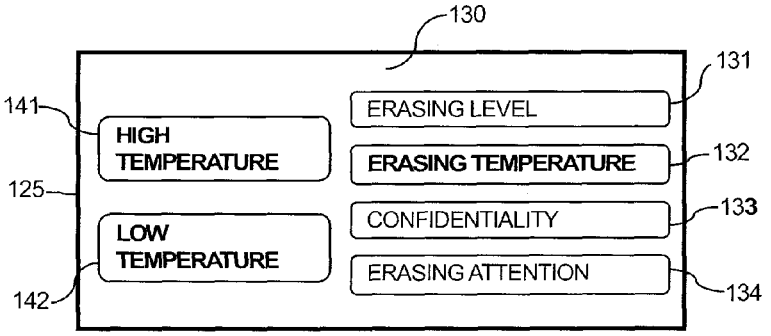

FIG. 6B illustrates the erasing mode setting screen 130 in a state where the erasing temperature mode display portion 132 receives the operation (touch) of the user (erasing temperature mode). As illustrated in FIG. 6B, when the erasing temperature mode display portion 132 is selected by the user, the monitor 109 changes the display color of the erasing temperature mode display portion 132 from gray to black. Further, the monitor 109 changes displayed contents of the first degree of freedom selecting portion 141 into characters of "high temperature" indicating that the degree of freedom is low and displayed contents of the second degree of freedom selecting portion 142 into characters of "low temperature" indicating that the degree of freedom is high. Therefore, in the erasing mode setting screen 130 illustrated in FIG. 6B, the user determines the degree of freedom regarding whether to erase the image from the erasing temperature mode to select "high temperature" or "low temperature".

Figure 6C:
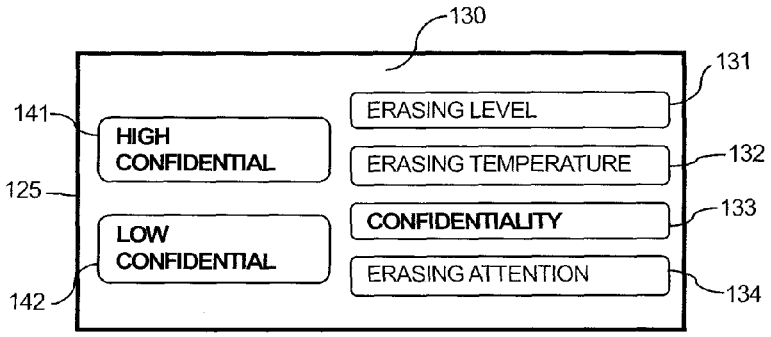

FIG. 6C illustrates the erasing mode setting screen 130 in a state where the confidentiality mode display portion 133 receives the operation (touch) of the user (confidentiality mode). As illustrated in FIG. 6C, when the confidentiality mode display portion 133 is selected by the user, the monitor 109 changes the display color of the confidentiality mode display portion 133 from gray to black. Further, the monitor 109 changes displayed contents of the first degree of freedom selecting portion 141 into characters of "high confidential" indicating that the degree of freedom is low and displayed contents of the second degree of freedom selecting portion 142 into characters of "low confidential" indicating that the degree of freedom is high. Therefore, in the erasing mode setting screen 130 illustrated in FIG. 6C, the user determines the degree of freedom regarding whether to erase the image from the confidentiality mode to select "high confidential" or "low confidential".

Figure 6D:
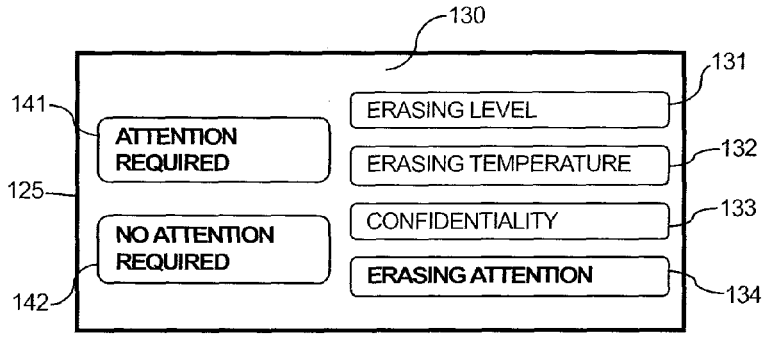

Further, FIG. 6D illustrates the erasing mode setting screen 130 in a state where the erasing attention mode display portion 134 receives the operation (touch) of the user (erasing attention mode). As illustrated in FIG. 6D, when the erasing attention mode display portion 134 is selected by the user, the monitor 109 changes the display color of the erasing attention mode display portion 134 from gray to black. Further, the monitor 109 changes displayed contents of the first degree of freedom selecting portion 141 into characters of "attention required" indicating that the degree of freedom is low and displayed contents of the second degree of freedom selecting portion 142 into characters of "no attention required" indicating that the degree of freedom is high. Therefore, in the erasing mode setting screen 130 illustrated in FIG. 6D, the user determines the degree of freedom regarding whether to erase the image from the erasing attention mode to select "attention required" or "no attention required".

The image which is printed on the sheet S is formed by a toner which will be erased (the color of the toner becomes transparent) when being heated at a predetermined erasing temperature or higher. Therefore, as the erasing temperature of the toner which forms the image is high, the image is hardly erased, but as the erasing temperature of the toner which forms the image is low, the image is easily erased. As the heating temperature of the erasing unit 105 is high, the image is hardly erased, but as the heating temperature of the erasing unit 105 is low, the image is easily erased. In connection to this, when the degree of freedom regarding whether to erase the image which is printed on the sheet S is low, it is desirable that the image is hardly erased. Further, when a degree of freedom regarding whether to erase the image which is printed on the sheet S is high, it is desirable that the image is easily erased. Therefore, in the second embodiment, the degree of freedom regarding whether to erase the image corresponds to the first heating temperature and the second heating temperature of the erasing unit 105.

Accordingly, if the monitor 109 receives the operation for selecting the degree of freedom by the user, the image erasing apparatus 100 heats the sheet S at the first heating temperature or the second heating temperature in accordance with the operation of the user to select the degree of freedom to erase the image. Specifically, the first degree of freedom selecting portion 141 (degree of freedom is low) corresponds to the first heating temperature and the second degree of freedom selecting portion 142 (degree of freedom is high) corresponds to the second heating temperature.

Figure 5:
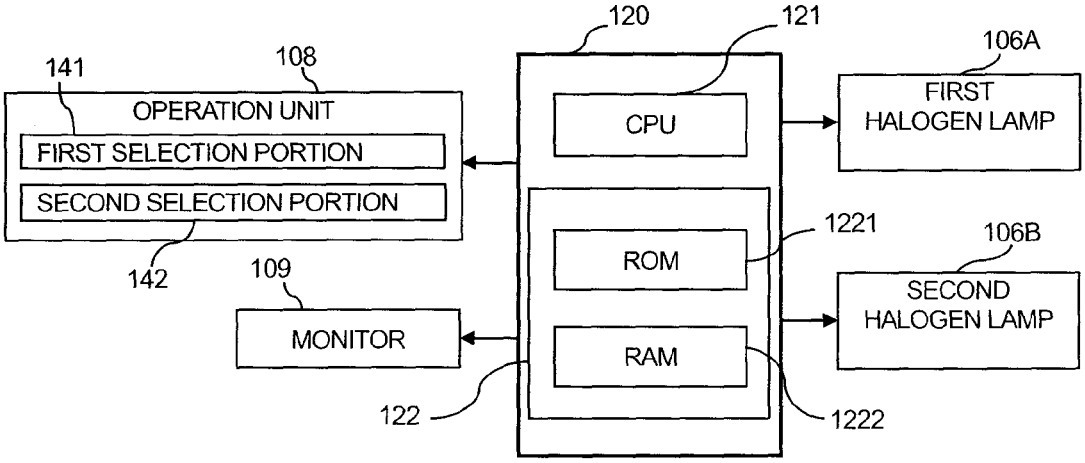
FIG. 5 is a block diagram illustrating a control unit which controls the image erasing apparatus according to the second embodiment.

FIG. 5 is a control block diagram of a control unit 120 which performs the display control of the monitor 109 and the heating temperature control of the erasing unit 105. The control unit 120 includes a processor 121, for example, configured by a CPU (central processing unit) and a memory 122.

The processor 121 acquires an operation signal from the operation unit 108 to read out display data of the erasing mode setting screen 130 (the erasing mode setting screen 130 illustrated in FIGS. 6A to 6D) corresponding to the mode display portions 131 to 134 which receive the operation of the user, from the memory 122 and allows the erasing mode setting screen 130 illustrated in FIGS. 6A to 6D to be displayed on the monitor 109. The processor 121 acquires the operation signal from the operation unit 108 to read out heating temperature control data corresponding to the degree of freedom selecting portions 141 and 142 which receive the operation of the user, from the memory 122, to output a heating temperature control signal for setting a heating temperature of the erasing unit 105 to the first heating temperature or the second heating temperature, to the erasing unit 105. Further, the processor 121 measures, for example, surface temperatures of a heating roller 105A and a pressure roller 105B using a measurement result by a temperature sensor which is not illustrated and outputs the heating temperature control signal for maintaining the heating temperature at the first heating temperature or the second heating temperature to the erasing unit 105. Further, in the second embodiment, the processor 121 acquires the operation signal from the operation unit 108 to control the operation of each part of the image erasing apparatus 100 described above.

The memory 122 is, for example, a semiconductor memory and includes a ROM (read only memory) 1221 and a RAM (random access memory) 1222. The ROM 1221 stores various control programs for performing display control of the monitor 109, heating temperature control of the erasing unit 105, and the operation control of each part of the image erasing apparatus 100. Further, the ROM 1221 stores display data for displaying the erasing mode setting screen 130 illustrated in FIGS. 6A to 6D and heating temperature control data regarding the first heating temperature and the second heating temperature. The RAM 1222 has a storage area as a working area which is temporally provided to the processor 121 when the processor 121 performs the above-mentioned control operation.

Hereinafter, an operation of the image erasing apparatus 100, which controls the heating temperature of the erasing unit 105 based on the control of the control unit 120 to erase the image which is printed on the sheet S, will be described. The operation unit 108 receives the operation by the user to output the operation signal to the processor 121. The processor 51 reads out the display data of the erasing mode setting screen 130 illustrated in FIG. 6A from the ROM 1221. The monitor 109 displays the erasing mode setting screen 130 illustrated in FIG. 6A (the erasing mode setting screen 130 in the erasing level mode) based on the read out display data, as an initial screen.

In the initial screen, the erasing level mode display portion 131 is displayed in black and the erasing temperature mode display portion 132, the confidentiality mode display portion 133, and the erasing attention mode display portion 134 are displayed in gray. By the difference in the display colors of the mode display portions 131 to 134, the user may visually recognize that the erasing mode setting screen 130 is in the erasing level mode. Characters of the high erasing level are displayed on the first degree of freedom selecting portion 141 and characters of the low erasing level are displayed on the second degree of freedom selecting portion 142. The user may determine the degree of freedom regarding whether to erase the image from the erasing level mode to select "high erasing level" or "low erasing level".

In the erasing mode setting screen 130 in the erasing level mode, for example, the user touches the second degree of freedom selecting portion 142 to select "low erasing level" and operates the image erase starting key of the operation unit 108. As a result, the operation unit 108 receives the operation by the user to output the operation signal to the processor 121. The processor 121 drives the conveyance mechanism (a sheet feeding roller 102, an aligning roller 103, a conveying unit 104, and a sheet discharging roller 107). The processor 121 reads out heating temperature data regarding the second heating temperature corresponding to the second degree of freedom selecting portion 142 from the ROM 1221 to output a heating temperature control signal for the second heating temperature to the erasing unit 105. The erasing unit 105 heats an image printed on the sheet S, which is conveyed from the sheet feeding unit 101 by the conveyance mechanism, at the second heating temperature to erase the image.

In the erasing mode setting screen 130 in the erasing level mode, the user touches the first degree of freedom selecting portion 141 to select "high erasing level" and operates the image erase starting key of the operation unit 108. As a result, the operation unit 108 receives the operation by the user to output the operation signal to the processor 121. The processor 121 drives the conveyance mechanism. The processor 121 reads out heating temperature data regarding the first heating temperature corresponding to the first degree of freedom selecting portion 141 from the ROM 1221 to output a heating temperature control signal for the first heating temperature to the erasing unit 105. The erasing unit 105 heats an image printed on the sheet S, which is conveyed by the conveyance mechanism, at the first heating temperature to erase the image.

In the initial screen of the erasing mode setting screen 130 illustrated in FIG. 6A, the user selects the erasing temperature mode display portion 132. As a result, the operation unit 108 receives the operation by the user to output the operation signal to the processor 121. The processor 121 reads out the display data of the erasing mode setting screen 130 illustrated in FIG. 6B from the ROM 1221. The monitor 109 displays the erasing mode setting screen 130 illustrated in FIG. 6B (the erasing mode setting screen 130 in the erasing temperature mode) based on the read out display data.

In the erasing mode setting screen 130 illustrated in FIG. 6B, the erasing temperature mode display portion 132 is displayed in black and the erasing level mode display portion 131, the confidentiality mode display portion 133, and the erasing attention mode display portion 134 are displayed in gray. By the difference in the display colors of the mode display portions 131 to 134, the user may visually recognize that the erasing mode setting screen 130 is in the erasing temperature mode. Further, characters of the high temperature are displayed on the first degree of freedom selecting portion 141 and characters of the low temperature are displayed on the second degree of freedom selecting portion 142. The user may determine the degree of freedom regarding whether to erase the image from the erasing temperature mode to select "high temperature" or "low temperature".

In the erasing mode setting screen 130 in the erasing temperature mode, for example, the user touches the second degree of freedom selecting portion 142 to select "low temperature" and operates the image erase starting key of the operation unit 108. As a result, the operation unit 108 receives the operation by the user to output the operation signal to the processor 121. The processor 121 drives the conveyance mechanism. The processor 121 outputs the heating temperature control signal for the second heating temperature corresponding to the second degree of freedom selecting portion 142 to the erasing unit 105. The erasing unit 105 heats an image printed on the sheet S, which is conveyed from the sheet feeding unit 101 by the conveyance mechanism, at the second heating temperature to erase the image.

In the erasing mode setting screen 130 in the erasing temperature mode, for example, the user touches the first degree of freedom selecting portion 141 to select "high temperature" and operates the image erase starting key of the operation unit 108. As a result, the operation unit 108 receives the operation by the user to output the operation signal to the processor 121.

The processor 121 drives the conveyance mechanism. Further, the processor 121 outputs the heating temperature control signal for the first heating temperature corresponding to the first degree of freedom selecting portion 141 to the erasing unit 105. The erasing unit 105 heats an image printed on the sheet S, which is conveyed from the sheet feeding unit 101 by the conveyance mechanism, at the first heating temperature to erase the image.

In the initial screen of the erasing mode setting screen 130 illustrated in FIG. 6A, the user selects the confidentiality mode display portion 133. As a result, the operation unit 108 receives the operation by the user to output the operation signal to the processor 121. The processor 121 reads out the display data of the erasing mode setting screen 130 illustrated in FIG. 6C from the ROM 1221. The monitor 109 displays the erasing mode setting screen 130 illustrated in FIG. 6C (the erasing mode setting screen 130 in the confidentiality mode) based on the read out display data.

In the erasing mode setting screen 130 in the confidentiality mode illustrated in FIG. 6C, the confidentiality mode display portion 133 is displayed in black and the erasing level mode display portion 131, the erasing temperature mode display portion 132, and the erasing attention mode display portion 134 are displayed in gray. By the difference in the display colors of the mode display portions 131 to 134, the user may visually recognize that the erasing mode setting screen 130 is in the confidentiality mode. Further, characters of the high confidential are displayed on the first degree of freedom selecting portion 141 and characters of the low confidential are displayed on the second degree of freedom selecting portion 142. The user may determine the degree of freedom regarding whether to erase the image from the confidentiality mode to select "high confidential" or "low confidential".

In the erasing mode setting screen 130 in the confidentiality mode, for example, the user touches the second degree of freedom selecting portion 142 to select "low confidential" and operates the image erase starting key of the operation unit 108. As a result, the operation unit 108 receives the operation by the user to output the operation signal to the processor 121. The processor 121 drives the conveyance mechanism. Further, the processor 121 outputs the heating temperature control signal for the second heating temperature corresponding to the second degree of freedom selecting portion 142 to the erasing unit 105. The erasing unit 105 heats an image printed on the sheet S, which is conveyed by the conveyance mechanism, at the second heating temperature to erase the image.

In the erasing mode setting screen 130 in the confidentiality mode, for example, the user touches the first degree of freedom selecting portion 141 to select "high confidential" and operates the image erase starting key of the operation unit 108. As a result, the operation unit 108 receives the operation by the user to output the operation signal to the processor 121. The processor 121 drives the conveyance mechanism. Further, the processor 121 outputs the heating temperature control signal for the first heating temperature corresponding to the first degree of freedom selecting portion 141 to the erasing unit 105. The erasing unit 105 heats an image printed on the sheet S, which is conveyed by the conveyance mechanism, at the first heating temperature to erase the image.

In the initial screen of the erasing mode setting screen 130 illustrated in FIG. 6A, the user selects the erasing attention mode display portion 134. As a result, the operation unit 108 receives the operation by the user to output the operation signal to the processor 121. The processor 121 reads out the display data of the erasing mode setting screen 130 illustrated in FIG. 6D from the ROM 1221. The monitor 109 displays the erasing mode setting screen 130 illustrated in FIG. 6D (the erasing mode setting screen 130 in the erasing attention mode) based on the read out display data.

In the erasing mode setting screen 130 in the erasing attention mode illustrated in FIG. 6D, the erasing attention mode display portion 134 is displayed in black and the erasing level mode display portion 131, the erasing temperature mode display portion 132, and the confidentiality mode display portion 133 are displayed in gray. By the difference in the display colors of the mode display portions 131 to 134, the user may visually recognize that the erasing mode setting screen 130 is in the erasing attention mode. Further, characters of attention required are displayed on the first degree of freedom selecting portion 141 and characters of no attention required are displayed on the second degree of freedom selecting portion 142. The user may determine the degree of freedom regarding whether to erase the image from the erasing attention mode to select "attention required" or "no attention required".

In the erasing mode setting screen 130 in the erasing attention mode, for example, the user touches the second degree of freedom selecting portion 142 to select "no attention required" and operates the image erase starting key of the operation unit 108. As a result, the operation unit 108 receives the operation by the user to output the operation signal to the processor 121. The processor 121 drives the conveyance mechanism. Further, the processor 121 outputs the heating temperature control signal for the second heating temperature corresponding to the second degree of freedom selecting portion 142 to the erasing unit 105. The erasing unit 105 heats an image printed on the sheet S, which is conveyed by the conveyance mechanism, at the second heating temperature to erase the image.

In the erasing mode setting screen 130 in the erasing attention mode, for example, the user touches the first degree of freedom selecting portion 141 to select "attention required" and operates the image erase starting key of the operation unit 108. As a result, the operation unit 108 receives the operation by the user to output the operation signal to the processor 121. The processor 121 drives the conveyance mechanism. Further, the processor 121 outputs the heating temperature control signal for the first heating temperature corresponding to the first degree of freedom selecting portion 141 to the erasing unit 105. The erasing unit 105 heats an image printed on the sheet S, which is conveyed by the conveyance mechanism, at the first heating temperature to erase the image.

The user may select the mode for determining the degree of freedom from the plurality of mode display portions 131 to 134 which are menus selected by the user to exchange the erasing mode setting screen 130 of FIGS. 6A to 6D. Therefore, the user may instinctively select the degree of freedom regarding whether to erase the image.

In the sheet feeding unit 101, a sheet on which an image whose erasing temperature may be identified is printed (hereinafter, referred to as a sheet S1), for example, a sheet on which the image is printed by the image forming apparatus 10 according to the first embodiment is accommodated. Specifically, a sheet on which the image is printed by the first toner having a high erasing temperature (hereinafter, referred to as a sheet S11) and a sheet on which the image is printed by the second toner having a low erasing temperature (hereinafter, referred to as a sheet S12) may be mixed to be accommodated in the sheet feeding unit 101, or only the sheet S11 may be accommodated in the sheet feeding unit 101, or only the sheet S12 may be accommodated in the sheet feeding unit 101. In such a sheet accommodating state, in order to erase images on all sheets accommodated in the sheet feeding unit 101, the heating temperature in the erasing unit 105 may be set to be high (first heating temperature). For example, in the erasing mode setting screen 130 in the erasing temperature mode, if the user touches the first degree of freedom selecting portion 141 to select the high temperature as the degree of freedom, the images on all sheets may be certainly erased at the first heating temperature.

In contrast, if only the sheet S12 is accommodated in the sheet feeding unit 101, in order to erase the images on all sheets accommodated in the sheet feeding unit 101, the heating temperature in the erasing unit 105 may be high (first heating temperature) or may be low (second heating temperature). For example, in the erasing mode setting screen 130 in the erasing temperature mode, when the user touches the second degree of freedom selecting portion 142 to select the low temperature as the degree of freedom, the image may be erased with less power consumption.

The image printed on the sheet S12 may be the image which may be erased without restrictions (for example, an image as a note) or an image having low confidentiality, or an image which does not require the attention to erase. Therefore, in the erasing mode setting screen 130 in the erasing level mode, even when the user touches the second degree of freedom selecting portion 142 to select the low erasing level as the degree of freedom, the image may be erased with less power consumption. In the erasing mode setting screen 130 in the confidentiality mode, even when the user touches the second degree of freedom selecting portion 142 to select the low confidential as the degree of freedom, the image may be erased with less power consumption. In the erasing mode setting screen 130 in the erasing attention mode, even when the user touches the second degree of freedom selecting portion 142 to select the no required attention as the degree of freedom, the image may be erased with less power consumption. As described above, the mode for determining the degree of freedom regarding whether to erase the image is changed to select the degree of freedom so that the user may erase the image with less power consumption.

In a case where the sheet S11 and the sheet S12 are mixed to be accommodated in the sheet feeding unit 101, when the user wants to erase only the image on the sheet S12 without erasing the image on the sheet S11, the heating temperature in the erasing unit 105 may be low. Therefore, for example, in the erasing mode setting screen 130 in the erasing temperature mode, when the user touches the second degree of freedom selecting portion 142 to select the low temperature as the degree of freedom, only the image on the sheet S12 may be selectively erased without erasing the image on the sheet S11. Further, even when the user touches the second degree of freedom selecting portion 142 to select the low erasing level as the degree of freedom, only the image on the sheet S12 may be selectively erased. In the erasing mode setting screen 130 in the confidentiality mode, even when the user touches the second degree of freedom selecting portion 142 to select the low confidential as the degree of freedom, only the image on the sheet S12 may be selectively erased. In the erasing mode setting screen 130 in the erasing attention mode, even when the user touches the second degree of freedom selecting portion 142 to select the no attention required as the degree of freedom, only the image on the sheet S12 may be selectively erased. As described above, before erasing the contents of the image on the sheet S, the user need not visually check the contents of the image whether the image printed on the sheet S is an image which is hardly permitted to be erased without restrictions or a high confidential image, or an image which requires an attention to erase the image, but the user may simply select the degree of freedom regarding whether to erase the image, so that it is possible to shorten the erasing time in the image erasing apparatus 100 and the high confidential image is not erroneously erased. Further, the image erasing apparatus 100 does not need a hardware configuration called as an image reading unit which checks the contents of the image on the sheet S11 before being erased.

In the sheet feeding unit 101, not only the sheet S1, but also a sheet on which the image is printed with an erasable toner whose erasing temperature is not identified (hereinafter, referred to as a sheet S2) may be accommodated. Even in such a sheet accommodating state, in order to erase images on all sheets S1 and S2, the heating temperature in the erasing unit 105 may be set to be high. For example, when the first heating temperature is set to a sufficiently high temperature, in the erasing mode setting screen 130 in the erasing temperature mode, the user touches the first degree of freedom selecting portion 141 to select the high temperature as the degree of freedom to erase the images, which are printed on all sheets S accommodated in the sheet feeding unit 101, at the first heating temperature.

As described above, according to the image erasing apparatus 100 of the second embodiment, the user selects the degree of freedom regarding whether to erase the image so that the image may be erased at a heating temperature corresponding to the selected degree of freedom. The user may select the heating temperature which is the erasing process condition of the image. The user may select a mode that determines the degree of freedom regarding whether to erase the image and select the degree of freedom from the selected determination mode.

In the second embodiment, not only the sheet S whose image is erased, but also the sheet S whose image is not erased may be discharged by the sheet discharging roller 107. Therefore, the discharged sheet S is scanned to inspect whether to erase the image and the discharging destination of the sheet S having an image and the sheet S having no image may be varied based on the inspecting result.

In the second embodiment, even though as the heating temperature, two types of temperatures, for example, high temperature and the low temperature are selected, the heating temperature may be selected from three or more types of different temperatures. In other words, three or more degree of freedom selecting portions illustrated in FIG. 6 are provided and for example, in the case of the erasing level mode, the display of the degree of freedom selecting portion may be configured by a high erasing level, an intermediate erasing level, and a low erasing level.

Even though the first and second embodiments describe a case that both the image forming apparatus and the image erasing apparatus are single bodies, the image erasing apparatus of the second embodiment is provided in the image forming apparatus of the first embodiment and the fixing unit and the erasing unit may be shared.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus which forms an erasable image on a recording medium, comprising:

an image forming unit configured to accommodate a plurality of color materials which is erasable and has different erasing properties and to form an erasable image on the recording medium using at least one of the color materials;

an operation unit configured to receive selection of at least one of degrees of freedom regarding whether to erase the image formed by the image forming unit; and a control unit configured to allow the image forming unit to form the image using the at least one of color materials corresponding to the at least one of degrees of freedom received by the operation unit.

2. The image forming apparatus according to claim 1, wherein the operation unit has a monitor and the monitor displays the degrees of freedom in different modes for determining whether to erase the image.

3. The image forming apparatus according to claim 1, wherein the operation unit has a monitor and the monitor displays a plurality of modes for determining whether to erase the image and receives selection of at least one of the modes for determining whether to erase the image.

4. The image forming apparatus according to claim 3, wherein the monitor displays the degrees of freedom in accordance with the received at least one of modes for determining whether to erase the image.

5. The image forming apparatus according to claim 1, wherein the color materials accommodated in the image forming unit are erased when the color materials are heated at different erasing temperatures as erasing properties or higher.

6. An image erasing apparatus which erases an image formed on a recording medium, comprising:

an erasing unit configured to erase the image on the recording medium using at least one of a plurality of erasing process conditions;

an operation unit configured to receive selection of at least one of degrees of freedom regarding whether to erase the image formed on the recording medium; and a control unit configured to allow the erasing unit to erase the image using the at least one of erasing process conditions corresponding to the at least one of the degrees of freedom received by the operation unit.

7. The image erasing apparatus according to claim 6, wherein the operation unit has a monitor and the monitor displays the degrees of freedom in different modes for determining whether to erase the image.

8. The image erasing apparatus according to claim 6, wherein the operation unit has a monitor and the monitor displays a plurality of modes for determining whether to erase the image and receives selection of at least one of the modes for determining whether to erase the image.

9. The image erasing apparatus according to claim 8, wherein the monitor displays the degrees of freedom in accordance with the received at least one of the modes for determining whether to erase the image.

10. The image erasing apparatus according to claim 6, wherein the erasing unit erases the image by heating at different temperatures as the erasing process conditions.

* * * * *